US005391848A

United States Patent [19]

Murphy

[11] Patent Number: 5,391,848

[45] Date of Patent: Feb. 21, 1995

[54] PUSH BUTTON SWITCH ILLUMINATED BY LIGHT EMITTING DIODES FOR USE WITH ELEVATORS

[75] Inventor: James L. Murphy, Streamwood, Ill.

[73] Assignee: Inventio AG, Hergiswil NW, Switzerland

[21] Appl. No.: 30,585

[22] Filed: Mar. 12, 1993

[51] Int. Cl.[6] ..... H01H 9/00

[52] U.S. Cl. ..... 200/314; 200/341; 200/310; 200/313

[58] Field of Search ..... 200/314, 341, 310, 311, 200/312, 313, 317

[56] References Cited

U.S. PATENT DOCUMENTS

| | | | |
|---|---|---|---|
| 3,157,771 | 11/1964 | Roeser | 200/314 |
| 4,332,990 | 6/1982 | Stevens | 200/314 |
| 4,496,813 | 1/1985 | Fukushima | 200/314 |
| 4,722,028 | 1/1988 | Brannon et al. | 362/29 |
| 4,742,198 | 5/1988 | Martin et al. | 200/286 |
| 4,752,242 | 6/1988 | Yoshimura | 439/620 |
| 4,910,368 | 3/1990 | Honda et al. | 200/314 |
| 4,956,528 | 9/1990 | Jannieve et al. | 200/314 |
| 5,150,257 | 9/1992 | Mohabbatizadeh et al. | 362/29 |

FOREIGN PATENT DOCUMENTS

| | | |
|---|---|---|
| 446487 | 9/1991 | European Pat. Off. . |
| 526838 | 2/1993 | European Pat. Off. . |
| 90151151 | 3/1991 | Germany . |
| 648150 | 2/1985 | Switzerland . |
| 2242572 | 10/1991 | United Kingdom . |

*Primary Examiner*—Henry J. Recla
*Assistant Examiner*—David J. Walczak
*Attorney, Agent, or Firm*—Howard & Howard

[57] ABSTRACT

A push button switch provides a visual switch actuation acknowledgement signal when actuated. The switch includes an end ring which extends through a cover plate. A push button extends into the end ring and has a lens cap which is exposed to a switch operator at a front surface of the cover plate. The push button also has a plurality of plungers which extend rearwardly through an adapter to actuate an electrical switch mounted on a switch block. The end ring, the push button, the adapter and the switch block are retained on a pair of studs extending from a rear surface of the cover plate by a pair of nuts. A light reflector is positioned between the push button and the adapter and has a forward reflector portion and a smaller diameter rearward base portion which form a radially extending shoulder. The base portion is inserted into an opening in the adapter and is mounted on the adapter by contact with the shoulder. A printed circuit board having light emitting diodes and a diode rectifier bridge mounted thereon is retained in a recess formed in the base portion of the light reflector. A pair of wires connected to the printed circuit board connect the bridge rectifier to a power supply.

13 Claims, 2 Drawing Sheets

PUSH BUTTON SWITCH ILLUMINATED BY LIGHT EMITTING DIODES FOR USE WITH ELEVATORS

BACKGROUND OF THE INVENTION

The invention relates generally to push button switches for elevators and, in particular, to a push button switch having a transparent push button illuminated from the rear by light emitting diodes.

Shown in the German design patent G 90 15 115.1 is a light element utilizing light emitting semiconductors for illuminating a push button switch. Arranged in the forward end of the push button switch is a ring shaped light conductor adjacent to a printed circuit board on which are mounted a plurality of light emitting semiconductors facing the ring conductor and the front of the push button. Upon actuation of the push button by an operator, the light emitting diodes are activated and emitted light is conducted by the ring conductor whereby a luminous ting becomes visible to the operator as an acknowledgement signal at the face of the push button. The light emitting semiconductors, also called light emitting diodes, are controlled in response to the ambient lighting by means of photosemiconductors, such that the visible luminous ring becomes brighter as the ambient light becomes brighter.

A disadvantage of the above described device is that the light emitted by the light emitting diodes is insufficient to provide a positive acknowledgement signal when the ambient illumination level is elevated. A further disadvantage is that the construction of the circuit board and the ring conductor makes the push button switch expensive to manufacture.

SUMMARY OF THE INVENTION

The present invention concerns a lighted push button switch for elevators wherein light from light emitting diodes is guided onto a transparent push button to generate a visual switch actuation acknowledgement signal for the elevator. The push button switch includes a transparent push button, an adapter for slidably retaining the push button, a plurality of light emitting diodes mounted on a printed circuit board for lighting the push button and a light reflector for guiding light generated by the light emitting diodes to the push button, the light reflector including a reflector portion and a base portion, the base portion having means for retaining the printed circuit board and the light reflector having means for mounting on the adapter. The base portion has a recess formed therein with a radially extending wall for retaining the printed circuit board. The base portion is smaller than the reflector portion thereby forming a radially extending shoulder between the portions for mounting on the adapter. A plurality of axially extending apertures are formed in the light reflector for guiding light generated by associated ones of the light emitting diodes to the push button and the apertures are positioned with one of the apertures generally concentric with a longitudinal axis of the light reflector and other ones of the apertures spaced from the one aperture in a generally square pattern. Each of the light emitting diodes is positioned on the printed circuit board adjacent an associated one of the apertures. The light emitting diodes are electrically connected in series across one branch of a bridge rectifier circuit mounted on the printed circuit board and another branch of the bridge rectifier circuit is connected to a pair of wires for connecting the light emitting diodes to a power supply.

The present invention solves the problem of the prior art switches by generating the acknowledgement signal with the luminance intensity of incandescent bulbs.

An advantage achieved by the present invention is that the incandescent bulbs in existing push button switches can be replaced with light emitting diodes without the aesthetic appearance of the switch being impaired by different luminous intensities.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
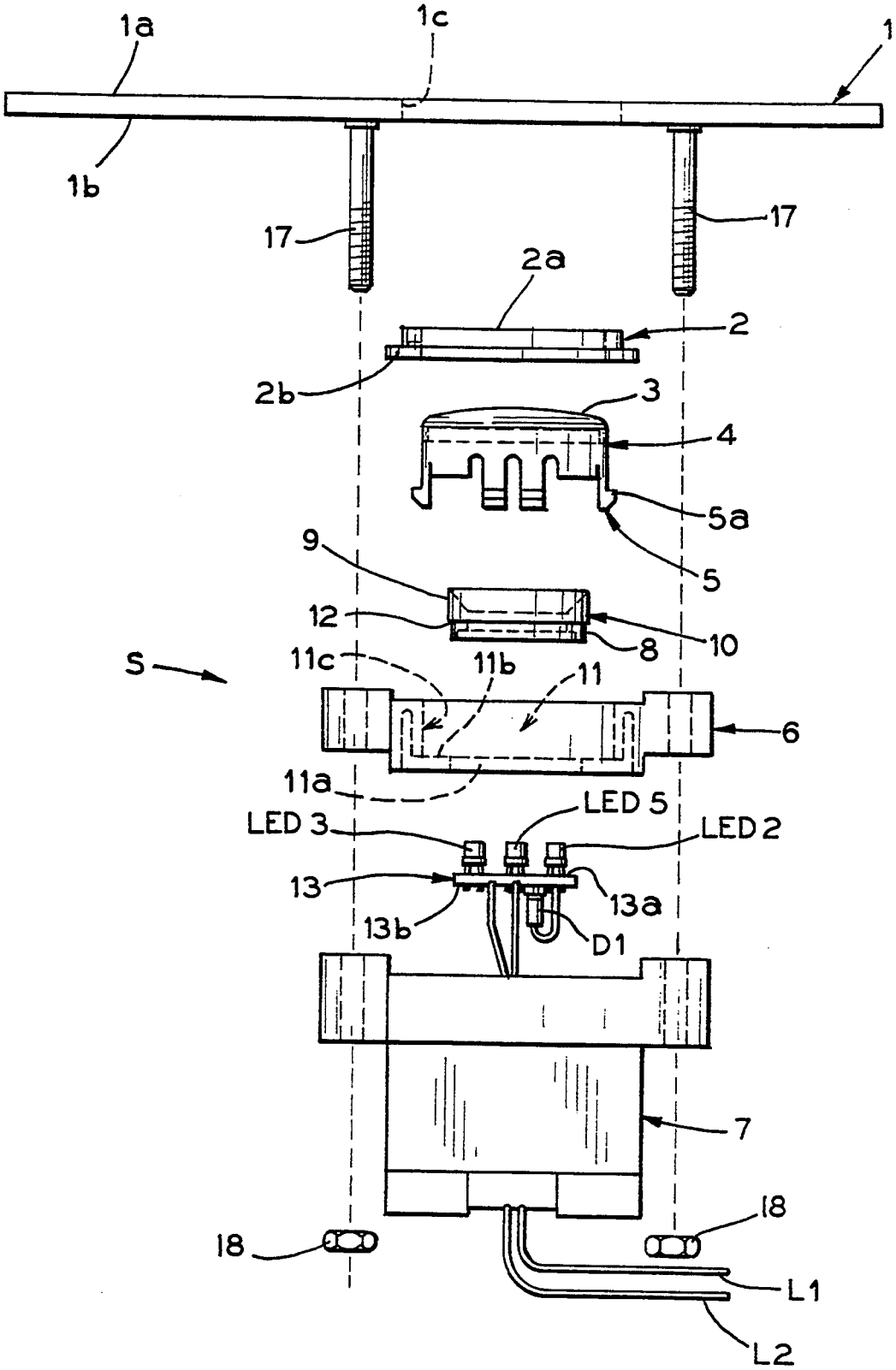
FIG. 1 is an exploded top plan view of a push button switch according to the invention.

In the FIG. 1, there is shown in exploded view a cover plate 1 to which a push button switch S according to the present invention is attached. The cover plate 1 has a front surface 1*a*, a rear surface 1*b* and an opening 1*c* formed therein through which a forward end of the push button switch S extends. The front surface 1*a* faces in a direction from which a person will actuate the switch S. The switch S includes an end ring 2 having a smaller diameter axially extending body 2*a*, the forward end of which passes through the opening 1*c*, and a larger diameter radially extending flange 2*b*, which abuts the rear surface 1*b* of the cover plate 1, formed at the rearward end of the body 2*a*. A cup-shaped push button 4 has an integral lens cap 3 which cap closes a forward end of the button and extends into an open center portion of the ring 2 at the tanged end thereof. A plurality of axially rearwardly extending plungers 5 are formed about a rearward open end of the push button 4 and extend through an adapter 6 for actuating an electrical switch (not shown) supported by a switch block 7 positioned on a rearward side of the adapter 6. Each of the plungers 5 has a radially outwardly extending protrusion 5*a* formed thereon for retaining and limiting axial movement of the push button 4 in the adapter 6. The ring 2, the push button 4, the adapter 6 and the switch block 7 are all of conventional construction of the type used for elevator push button switches illuminated by incandescent lamps such as the push button switch shown in the U.S. Pat. No. 4,742,198.

A light reflector 10 has a rearward base portion 8 and a forward reflector portion 9. The adapter 6 has a central opening 11 formed therein with a rearward portion 11*a* of the opening being smaller in diameter to form a forwardly facing step or shoulder 11*b*. The base portion 8 is slightly smaller in diameter than the reflector portion 9 to form a radially extending step or shoulder 12 therebetween. When the reflector 10 is inserted into the opening 11 from the forward side of the adapter 6, the base portion 8 extends into the rear portion 11*a* of the opening 11 and the shoulder 12 formed between the base portion 8 and the reflector portion 9 rests against the shoulder 11*b*. As the push button 4 is inserted into the opening 11, the plungers 5 will be bent inwardly such that the protrusions 5*a* clear a side wall 11*c* of the opening 11 and then spring back to the positions shown.

A printed circuit board 13 has a front surface 13*a* and a rear surface 13*b* and is mounted at the forward end of the switch block 7. A plurality of light emitting diodes LED1 through LED5 are mounted on the front surface 13*a* and a plurality of diodes D1 through D4 are mounted on the rear surface 13*b* of the printed circuit board 13. A pair of wires L1 and L2 each have one end connected to the printed circuit board and an opposite end for connecting to the electrical switch (not shown) on the switch block 7 and a power supply (not shown).

Figure 2:
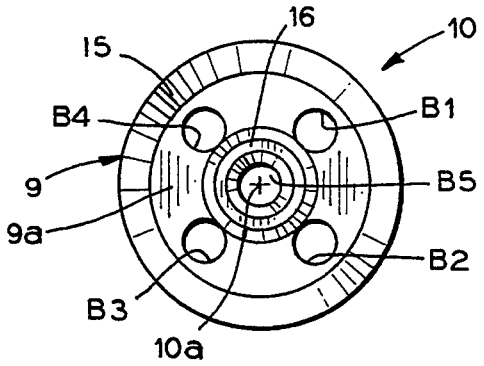
FIG. 2 is an enlarged front elevation view of the light reflector in the push button switch shown in the FIG. 1.
Figure 3:
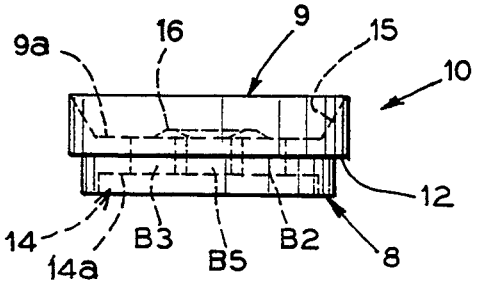
FIG. 3 is a side elevation view of the light reflector shown in the FIG. 2.
Figure 4:
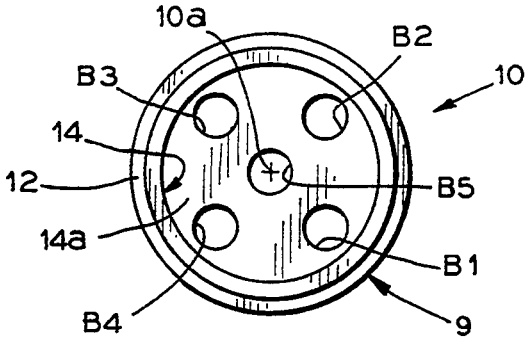
FIG. 4 is a rear elevation view of the light reflector shown in the FIG. 2.

As shown in the FIGS. 2 through 4, the reflector 10 has a plurality of axially extending apertures B1 through B5 formed therein. The central aperture B5 is positioned concentric with a longitudinal axis 10*a* of the reflector 10 and the apertures B1 through B4 are equally spaced from the axis 10*a* in a square pattern. A recess 14 extends into a rear surface 8*a* of the base portion 8 to form a radially extending wall 14*a*. The printed circuit board 13, having the same general shape as the recess 14, is inserted into the recess 14 until the front surface 13*a* contacts the wall 14*b*. The light emitting diodes LED1 through LED5 are positioned on the front surface 13*a* of the printed circuit board 13 in a pattern such that each of the light emitting diodes LED1 through LED5 extends into an associated one of the apertures B1 through BS. Light from each of the light emitting diodes passes through the light reflector 10 by way of the associated one of the apertures B1 through B5 from the base portion 8 into the reflector portion 9. A front surface 9*a* of the reflector portion 9 is recessed and has a side wall 15 which angles radially inwardly from the forward end of the reflector 10 to the front surface 9*a*. The central aperture B5 is surrounded by an annular wall 16 extending axially forward from the front surface 9*a*.

As shown in the FIG. 1, a pair of bolts or studs 17 are attached to and extend rearwardly from the rear surface 1*b* of the cover plate through respective apertures formed in the adapter 6 and the switch block 7. A pair of nuts 18 threadably engage the free ends of the respective studs 17 for maintaining the separate parts of the switch S together against the rear surface 1*b*. Depending upon the cross-sectional shape of the adapter 6, cylindrical, cubical or other differently shaped light reflectors 10 can be used.

In order that the light radiated by the light emitting diodes LED1 through LED5 and the light reflected by the reflector portion 9 should appear as white as possible and without shadow, the push button 4 can be made of transparent polycarbonate material with a white tint. The light emitting diodes LED1 through LED5 can emit, for example, light of a wavelength of 590 nanometers. Green, red or other differently colored light emitting diodes can be used as required.

Figure 5:
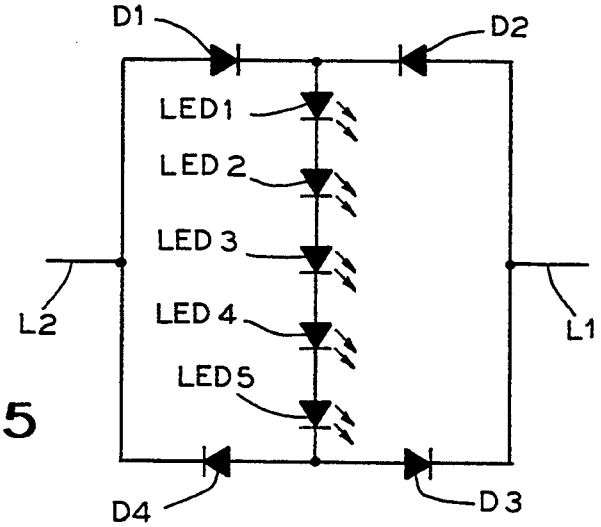
FIG. 5 is a schematic electrical circuit diagram of the operating circuit for the light emitting diodes shown in the FIG. 1.

The electrical circuit schematic diagram of the FIG. 5 is a representation of the electrical connections printed on the board 13 wherein the light emitting diodes LED1 through LED5 are connected in series across one branch of a bridge rectifier formed by the diodes D1 to D4. The other branch of the bridge is connected to the wires L1 and L2 which wires can be connected at their opposite ends to a supply voltage of tap to 120 volts AC through the electrical switch (not shown) on the switch block 7. When the push button 4 is actuated, the plungers 5 will actuate the electrical switch (not shown) and power will be supplied to the light emitting diodes LED1 through LED5 to provide a switch actuation acknowledgement visual signal to the operator at the lens cap 3. If a DC power supply is used instead, the legs of the bridge which include the diodes D1 and D3 can be removed and the diodes D2 and D4 will protect the light emitting diodes against damage due to reversed polarity.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A push button switch for generating a switch actuation acknowledgement signal for an elevator comprising:

a push button;

an adapter for slidably retaining said push button;

a plurality of light emitting diodes mounted on a printed circuit board for lighting said push button to generate a switch actuation acknowledgement signal; and a light reflector for guiding light generated by said light emitting diodes to said push button, said light reflector having means for retaining said printed circuit board, said light reflector including a reflector portion and a base portion, said base portion being smaller than said reflector portion to form a radially extending shoulder between said portions, and said light reflector having means for mounting said light reflector on said adapter, said means for mounting on said adapter including said shoulder, and including a plurality of axially extending apertures formed in said light reflector for guiding light generated by associated ones of said light emitting diodes to said push button.

2. The push button switch according to claim 1 wherein said base portion has a recess formed therein, said recess having radially extending wall, and said means for retaining said printed circuit board includes said wall.

3. The push button switch according to claim 1 wherein said apertures are positioned with one of said apertures generally concentric with a longitudinal axis of said light reflector and other ones of said apertures spaced from said one aperture and each of said light emitting diodes is positioned on said printed circuit board adjacent an associated one of said apertures.

4. The push button switch according to claim 1 wherein said light reflector has a generally cylindrical shape.

5. The push button switch according to claim 1 wherein said light emitting diodes are electrically connected in series across one branch of a bridge rectifier circuit mounted on said printed circuit board and another branch of said bridge rectifier circuit is connected to a pair of wires for connecting said light emitting diodes to a power supply.

6. The push button switch according to claim 1 wherein said light emitting diodes emit light with a wavelength of approximately 590 nanometers.

7. A push button switch for generating a switch actuation acknowledgement signal for an elevator comprising:

a push button;

an adapter for slidably retaining said push button;

a plurality of light emitting diodes mounted on a printed circuit board for lighting said push button to generate a switch actuation acknowledgement signal; and a light reflector for guiding light generated by said light emitting diodes to said push button, said light reflector including a reflector portion and a base portion, said base portion having means for retaining said printed circuit board and said light reflector having means for mounting on said adapter, and including a plurality of axially extending apertures formed in said light reflector for guiding light generated by associated ones of said light emitting diodes to said push button and wherein said apertures are positioned with one of said apertures generally concentric with a longitudinal axis of said light reflector and other ones of said apertures spaced from said one aperture in a generally square pattern and each of said light emitting diodes is positioned on said printed circuit board adjacent an associated one of said apertures whereby said push button is slidably movable relative to said adapter, said printed circuit board and said light reflector.

8. The push button switch according to claim 7 wherein said base portion has a recess formed therein, said recess having a radially extending wall, and said means for retaining said printed circuit board includes said wall.

9. The push button switch according to claim 7 wherein said base portion is smaller than said reflector portion forming a radially extending shoulder between said portions and said means for mounting on said adapter includes said shoulder.

10. A push button switch for an elevator comprising:

a push button having a plurality of plungers formed thereon;

an adapter, said plungers extending through said adapter for actuating an electrical switch, said adapter having a central opening with a step formed therein facing said push button;

a light reflector for guiding light to said push button, said light reflector having a smaller base portion and a larger reflector portion with a radially extending shoulder formed therebetween for engaging said step and mounting said light reflector, said base portion having a recess formed therein; and a printed circuit board having at least one light emitting diode mounted thereon, said printed circuit board being mounted in said recess in said base portion of said light reflector with said light emitting diode facing said push button whereby said push button is slidably movable relative to said adapter, said light reflector and said printed circuit board.

11. The light conductor according to claim 10 including at least one axially extending aperture formed in said light reflector for guiding light generated by the light emitting diode to the push button.

12. The light conductor according to claim 10 wherein said light reflector has a generally cylindrical shape.

13. The light conductor according to claim 10 including a plurality of light emitting diodes mounted on said printed circuit board and wherein said light reflector has a plurality of axially extending apertures formed therein, each of said apertures guiding light generated by an associated one of said light emitting diodes to said push button.

* * * * *